US006193809B1

(12) United States Patent
Hudson

(10) Patent No.: US 6,193,809 B1
(45) Date of Patent: Feb. 27, 2001

(54) RIGGING CABLE CLEANING DEVICE

(76) Inventor: Mark E. Hudson, P.O. Box 11541, Marina Del Rey, CA (US) 90292

( * ) Notice: Subject to any disclaimer, the term of this patent is extended or adjusted under 35 U.S.C. 154(b) by 0 days.

(21) Appl. No.: 09/191,791

(22) Filed: Nov. 13, 1998

Related U.S. Application Data

(60) Provisional application No. 60/065,910, filed on Nov. 17, 1997.

(51) Int. Cl.[7] ..... B08B 7/00

(52) U.S. Cl. ..... 134/9; 15/104.93; 15/104.04; 15/114; 15/222; 114/111; 114/221 R

(58) Field of Search ..... 15/104.04, 104.93, 15/104.94, 107, 114, 160, 209.1, 210.1, 256.5, 256.6, 220.4, 222; 134/9; 401/6, 8; 114/111, 221 R

(56) References Cited

U.S. PATENT DOCUMENTS 2,604,650 * 7/1952 Mottelson ..... 15/256.6
4,899,416 * 2/1990 Francis ..... 15/104.93
5,022,493 * 6/1991 Buckelew ..... 15/210.1
5,035,523 * 7/1991 Allinder ..... 15/222
5,386,609 * 2/1995 Xenos ..... 15/222
5,537,709 * 7/1996 Taragos ..... 15/222
5,545,456 * 8/1996 Suida ..... 15/222
5,639,532 * 6/1997 Wells ..... 15/209.1

FOREIGN PATENT DOCUMENTS

2194613 * 3/1988 (GB) .

* cited by examiner

*Primary Examiner*—Terrence R. Till
(74) *Attorney, Agent, or Firm*—Robert J. Schaap

(57) ABSTRACT

A rigging cable cleaning device primarily, although not exclusively, adapted for use on sailboat rigging cables, such as main sail cables, lanyard cables, and the like. The rigging cable cleaning device comprises an outer flexible fabric cover and an inner cleaning pad which can be folded or wrapped about a sailboat rigging cable. Holes with grommets are located on the ends of the outer fabric cover for receiving a releasable locking mechanism to thereby hold the cable cleaning device on a rigging cable. In this way, the device can be physically moved up and down or along the cable for cleaning same. The cleaning pad is removably attached to the inner surface of the fabric cover so that one type of cleaning pad can be substituted for another.

19 Claims, 3 Drawing Sheets

FIG. 1
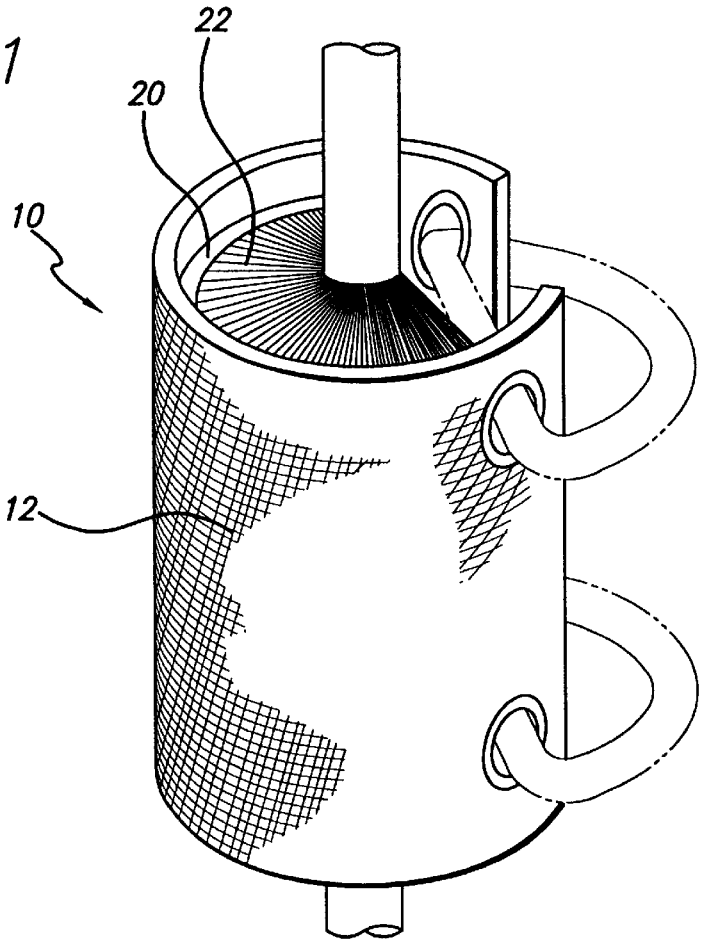
FIG. 1
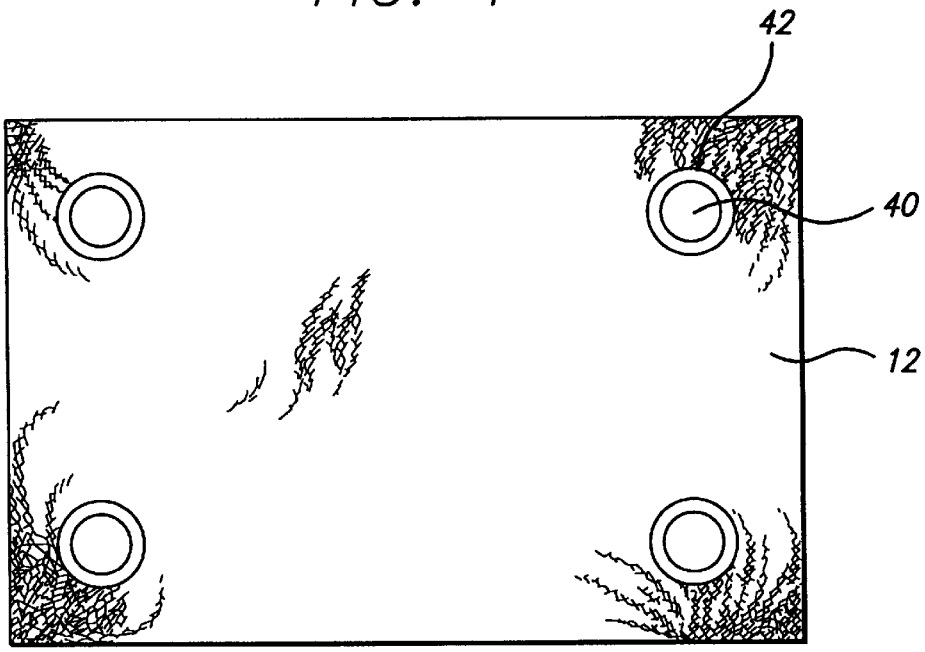
FIG. 2

RIGGING CABLE CLEANING DEVICE

RELATED APPLICATION

This application is a continuation of and based on my provisional patent application Ser. No. 60/065,910, filed Nov. 17, 1997, for "SAILBOAT RIGGING CLEANING DEVICE".

BACKGROUND OF THE INVENTION

1. Field of the Invention

This invention relates in general to certain new and useful improvements in rigging cable cleaning devices generally adapted for use with cleaning sailboat rigging cables and, more particularly, to an improved rigging cable cleaning device which allows for differing types of cleaning pads to be employed and which also enables convenient attachment and removal from a sailboat rigging cable for manual cleaning thereof.

2. Brief Description of the Related Art

The cleaning of rigging cables of the type normally used on sailboats is a persistent problem which continuously confronts the yachtsman. During sailing activities, a considerable amount of grime, dead insects and the like tend to accumulate on rigging cables of the type normally used on sailboats. This debris must be frequently cleaned from the rigging cable.

In addition to the foregoing, if the cables contain any metallic components or if they are formed of metal, corrosion is a constant problem and cleaning must be periodically maintained.

Cleaning of the sailboat rigging cable is important, not only for purposes of maintaining the longevity of the cable, but to prevent the falling of any components on which the cable may be wound about or retained. In addition, cleaning is desirable to present a higher aesthetic appearance of the entire sailboat.

There have been various proposals for cleaning of cables of the type used on sailboats and other types of boats. U.S. Pat. No. 1,950,959 to Winsette discloses an anchor chain cleaning device which is effectively designed to wrap about an anchor chain to be moved up and down the length of the anchor chain. U.S. Pat. No. 5,351,359 to Golden also discloses an anchor chain cleaning device similar in construction and operation to that taught in the aforesaid Winsette patent. The Golden patent also provides for a hand grip to enable movement of the anchor chain cleaning device up and down the anchor chain cable. The problems in cleaning anchor chains are totally different than the problems encountered in cleaning cables, such as halyard cables, main sail cables, and the like.

U.S. Pat. No. 3,791,330 to Haddad also discloses a cleaning device for wrapping about a cable and moving the device up and down the cable. However, Haddad suffers a number of disadvantages, not the least of which is the fact that it has no means for holding the device onto the cable. Moreover, Haddad proposes the use of sponges as a cleaning material and which is very limited in its cleaning ability.

There has also been a need for a device for lubricating rigging cables on sailboats and like structures. In this case, lubrication is largely provided by manual application of a lubricating oil which is applied directly to the cable. However, this is relatively inefficient inasmuch as there is no means to control the application of any lubricating oil or like lubricant to the application of any lubricating oil or like lubricant to the cable and, in addition, it is time consuming and labor intensive.

There has been a need for an effective cleaning device and a lubricating device which can be easily and quickly releasably locked to a rigging cable of a sailboat and similar devices. There has also been a need for an effective cleaning and/or lubricating device which is capable of effective movement with respect to a rigging cable by movement of the cable through the cleaning device. However, heretofore, there has not been any effective device of this type.

OBJECTS OF THE INVENTION

It is, therefore, one of the primary objects of the present invention to provide a rigging cable cleaning device capable of being effectively releasably locked to cables of sailboats and like devices.

It is another object of the present invention to provide a rigging cable cleaning device of the type stated in which removable pads can be mounted on the cable cleaning device for substitution of one type of cleaning pad for another.

It is a further object of the present invention to provide a rigging cable cleaning device of the type stated which is relatively small in size, but which is highly effective in cleaning of rigging cables used on sailboats.

It is an additional object of the present invention to provide a rigging cable cleaning device of the type stated which can be constructed at a relatively low cost and which is effectively used on a number of different sized cables.

It is also an object of the present invention to provide a lubricating device for applying a lubricant to a rigging cable.

It is another salient object of the present invention to provide a method of cleaning rigging cables by causing relative movement of a cleaning device with respect to the rigging cable.

It is also a salient object of the present invention to provide a method of lubricating a rigging cable.

With the above and other objects in view, my invention resides in the novel features of form, construction, arrangement and combination of parts and components presently described and pointed out in the claims.

BRIEF SUMMARY OF THE INVENTION

The present invention relates to a rigging cable cleaning device which can be effectively used on sailboat rigging cables. These sailboat rigging cables usually hold the mast in a fixed position. The cleaning device, which also effectively operates as a lubricating device, functions to clean and lubricate shrouds, stays, topping lifts, or any other form of cable or line which connects to a sailboat mast.

The rigging cable cleaning device of the present invention is comprised of an outer cover, preferably formed of a foldable or flexible fabric-type material, such as canvas or the like. It is, however, preferable to select materials which are at least moderately resistant to salt water corrosion if the boat is to be used in salt water sailing.

The outer cover with the pad therein is capable of being wrapped or folded about a rigging cable. A cleaning pad is also provided for removable mounting to the interior surface of the outer fabric cover. This cleaning pad may adopt numerous forms ranging from relatively light cleaning materials to bristle-type pads and abrasive-type cleaning pads.

Means is provided for releasably mounting the cleaning device to the interior surface of the outer fabric cover. In one embodiment, for example, this means for mounting may adopt the form of fiber fastening strips and in which the fiber fastening strips are secured to the fabric outer cover and cooperating and mating fiber fastening strips are mounted to the interior surface of the pad. However, other forms of attachment means may be provided.

The term "cleaning pad" is used in a broad sense herein to incorporate all forms of cleaning pads, including relatively soft pads and abrasive pads. It should also be understood that in the process of cleaning the cables, there is a inherent lubrication of same. However, it should also be understood that these cleaning pads could also be provided with a thin film of lubricating oil which will transfer to the cable as the pad is moved along the cable.

The edges of the outer cover opposite a fold line or wrap area are also provided with releasable locking means for releasably locking the cover with the cleaning or lubricating pad about a rigging cable. Again, fiber fastening strips may be provided for this purpose. In a preferred embodiment of the invention, a shackle is attached to the fabric cover and allowed to move up and down the rigging cable. In this way, there is a relative movement between the rigging cable and the cleaning device as the cable is moved relative to the cleaning device.

For this purpose, the outer fabric cover is further provided with grommet holes for receiving shackles or similar mechanism to literally secure the cleaning device to a rigging cable.

This invention possesses many other advantages and has other purposes which will be made more clearly apparent from a consideration of the forms in which it may be embodied. These forms are shown in the drawings forming a part of and accompanying the present specification. They will be described in detail for the purposes of illustrating the general principles of the invention. However, it is to be understood that the following detailed description and the accompanying drawings are not to be taken in a limiting sense.

BRIEF DESCRIPTION OF THE DRAWINGS

Figure 3:
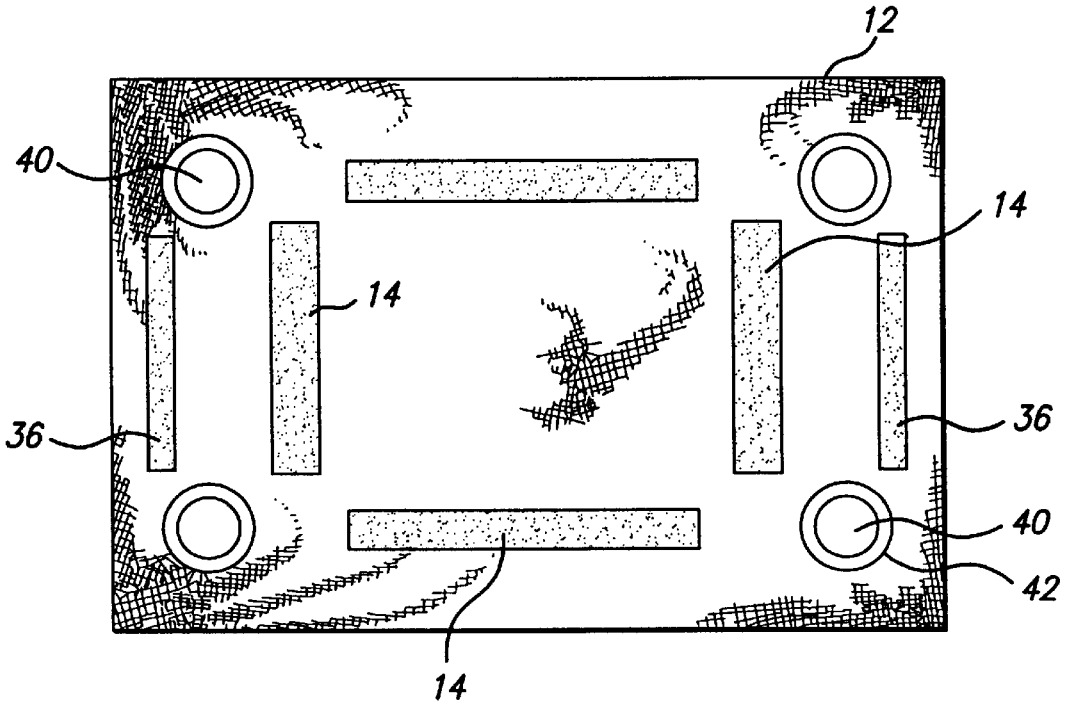
Figure 4:
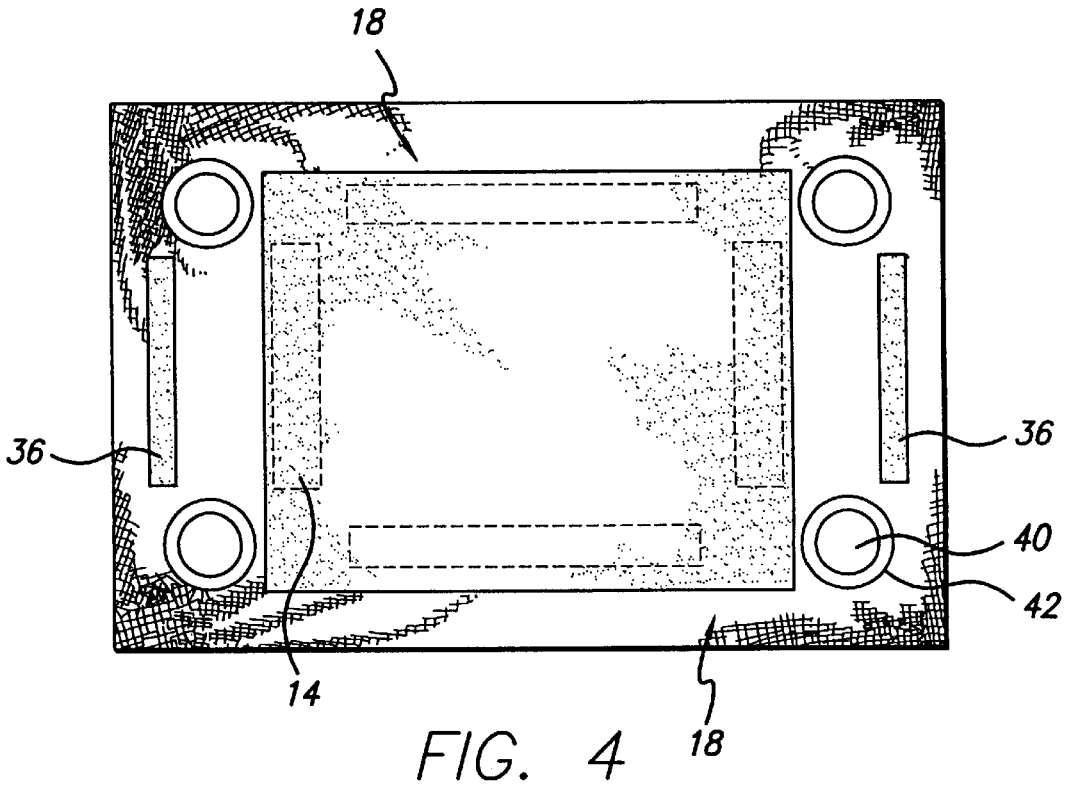
Figure 5:
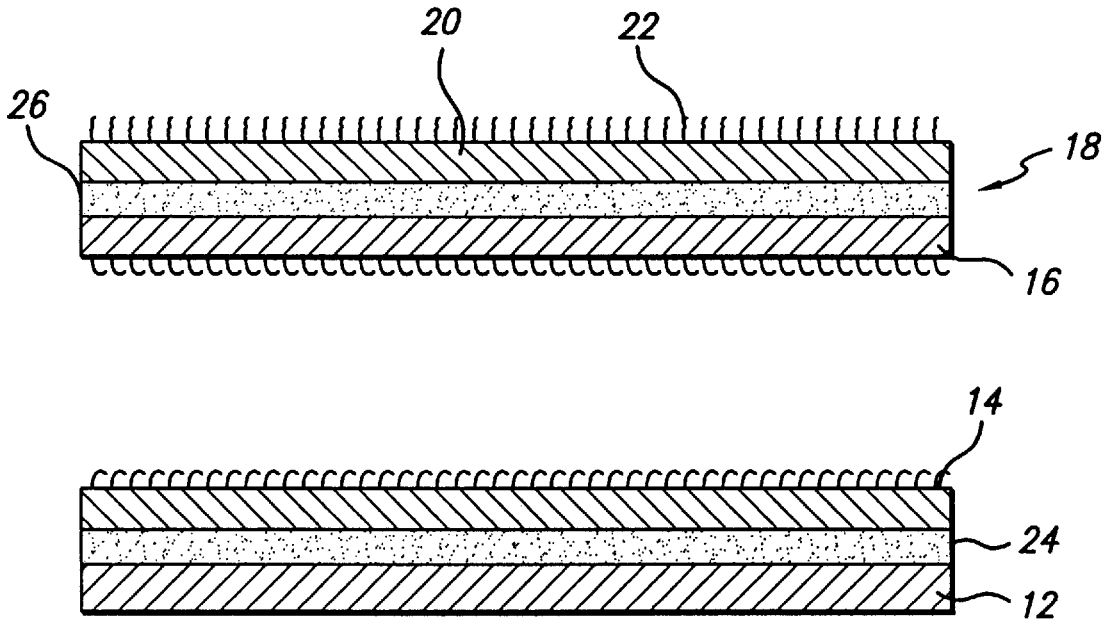

Having thus described the invention in general terms, reference will now be made to the accompanying drawings in which:

FIG. 1 is a perspective view of a rigging cable cleaning device constructed in accordance with and embodying the present invention;

FIG. 2 is a plan view showing the exterior of the cleaning device when in an unfolded or unwrapped condition;

FIG. 3 is a plan view of the interior surface of the cleaning device with cleaning pads removed therefrom;

FIG. 4 is a plan view, similar to FIG. 3, and showing the cleaning pads on the cover forming part of the cleaning device of the present invention;

FIG. 5 is a sectional view taken along line 5—5 of FIG. 4; and

Figure 6:
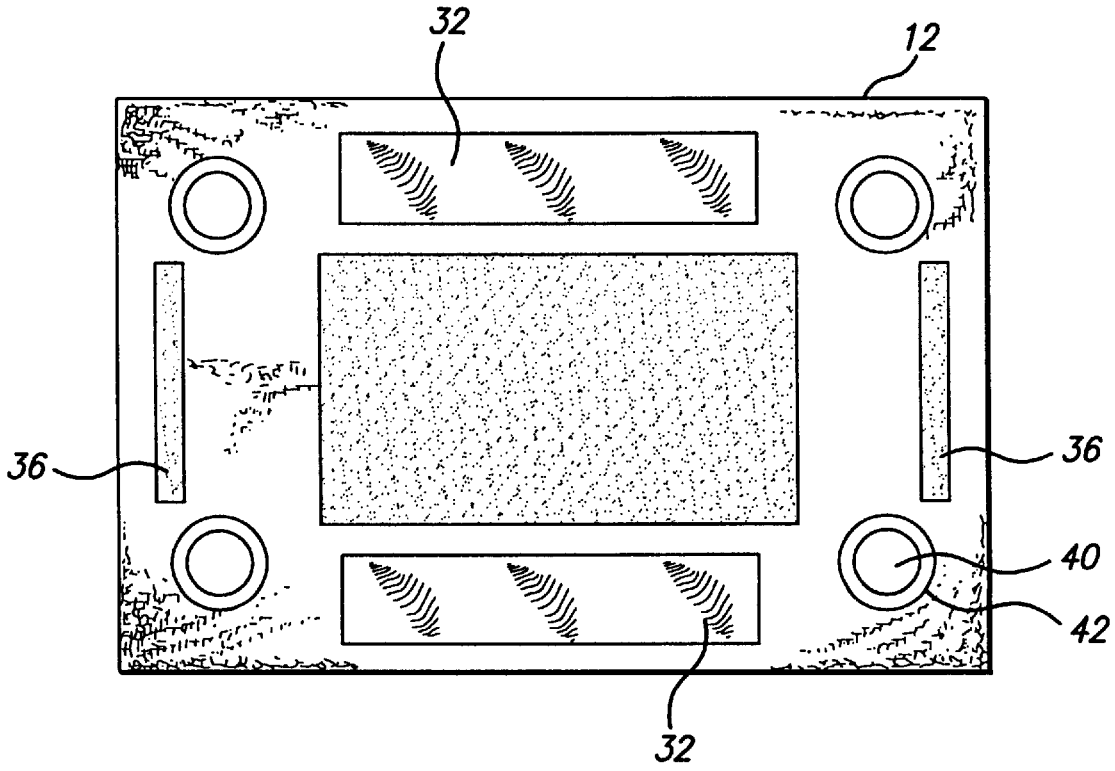

FIG. 6 is a plan view, similar to FIG. 4, and showing a modified form of cleaning or lubricating device constructed in accordance with and embodying the present invention.

DETAILED DESCRIPTION OF PREFERRED EMBODIMENT

Referring now in more detail and by reference characters to the drawings, which illustrate general principles of the present invention, 10 represents a rigging cable cleaning device which comprises an outer fabric cover 12 and which may preferably be formed of a flexible and foldable fabric material. In many environments and, particularly, in salt water environments, the fabric cover 12 is preferably made of a canvas material or otherwise a plastic coated fabric. For that matter, the fabric sheet could be an entire plastic sheet. Thus, the term "fabric", as used herein, is used in a broad sense to incorporate essentially any flexible and foldable material which is capable of being wrapped about a rigging cable. Thus, and for this purpose, the fabric cover could be formed of cotton or other know fabric materials.

Secured to the interior surface of the fabric cover 12, as best shown in FIG. 3, are a plurality of attachment strips 14. The attachment strips 14 are preferably fiber fastener attachment strips formed of either loops or fastener hooks and will mate with mating fiber fastening strips 16 on the underside of a fabric based cleaning pad 18. In this way, a cleaning pad 18 can be secured to the interior surface of the outer cover 12. By reference to FIG. 5, it can be seen that the cleaning pad also comprises a fabric substrate 20 in the form of an outer backing along with a cleaning surface 22. On its opposite surface, the pad is provided with the fiber fastening strips 16, as aforesaid.

The fiber attachment strips 14 are secured to the interior surface of the outer cover 12 by means of an adhesive layer 24. In like manner, the fiber fastening strips 16 facing the fiber attachment strips 14 is secured to the interior surface of the backing 18 by means of an adhesive layer 26. Any form of suitable adhesive may be provided for this purpose. In addition, it is also possible to use other means for attaching the fiber fastening strips to the respective substrates. Thus, for example, the fiber fastening attachment strips 14 could be secured to the cover 12 by means of stitching and, in like manner, the fiber fastening strips 16 could be secured to the backing substrate 18 by suitable lines of stitching.

In the embodiment of the invention as shown in FIGS. 3 and 4 there is provided a single cleaning pad 18. However, it should be understood that a plurality of cleaning pads could also be provided on the interior surface of the cover 12, as shown in FIG. 6. In this particular embodiment, a pad material 30 is employed and which may be a somewhat coarse cleaning pad having rough bristles for removing any material firmly embedded on a cable. In addition, two outer soft cleaning fabric pads 32 may also be employed for effectively wiping the cable after the abrasive action has taken place. This type of device has also been found to be highly effective in cleaning rigging cables. Again, the outer fabric layers 32 and the abrasive pad 30 may be secured to the outer cover by any of the means previously described for securing the cleaning pad 18. Moreover, it should be understood that any arrangement of cleaning pads may be employed and they may be employed in any number of various patterns. Also differing types of cleaning pads could be mounted on the interior surface of the outer cover 12.

The outer fabric cover 12 may also be provided on its interior surface adjacent opposite edges thereof with a pair of locking strips 36. Again, these locking strips may adopt the form of fiber fastener strips, such as the type of fiber fastening strips previously described including, for example, those fiber fastening strips offered under the name "Velcro".

The outer cover 12 is also provided with apertures or openings 40 surrounded by grommets 42 and which are suitably sized to receive shackles or like elements for securing the two ends together in an enveloping position around a rigging cable and to also hold the cleaning device onto a rigging cable in a loosely fitted arrangement. Shackles of the type which can be used are shown in dotted lines in FIG. 1, since they do not form part of the present invention.

However, and again, it should be understood that other means for holding the cleaning device in a surrounding position on a rigging cable can also be provided.

In use, the rigging cable cleaning device of the invention is effectively wrapped about a cable. If desired, the outer cover 12 may be provided with a fold line in order to fold two halves of the device about a cable. However, in a preferred embodiment, the device is capable of being wrapped about a cable.

The outer cover 12 is preferably formed of a strong durable and pliable material, as aforesaid. The cleaning pad may adopt various forms, as also indicated above. Preferably, they are often formed of scrubbing abrasive materials. Brush-like fibrous materials are effective for this purpose. The four grommets allow for easy attachment and detachment to the sailboat rigging cable. However, when the device has been folded into a U-shaped position around the cable, the user can press against the outer surfaces of both of the opposite sides and move the cleaning device along the length of the cable. The upper and lower grommets are in alignment in order to connect the halyard shackle to the cleaning device.

In this way, the cleaning device is allowed to travel up and down the sailboat rigging cable. The user can merely pull the end of the halyard line back and forth in order to create the cleaning motion. However, it should be understood that if the halyard line is not sufficiently long for connection to the lower set of grommets on the cleaning device, a heavy weighted pendant can be connected to the lower grommets in order to pull the same downwardly on the rigging cable.

The cable cleaning device of the present invention also effectively operates to lubricate the cables in the cleaning thereof. However, and as also indicated above, it should be understood that absorbent type pads could be used in place of the abrasive pads. This absorbent type pads could be provided with a type of lubricating oil or other protective oil for purposes of rubbing same onto the cable as there is relative movement between the pad and the cable.

Thus, there has been illustrated and described a unique and novel rigging cable cleaning device which is effectively usable on essentially all cables of sailboats and which thereby fulfills all of the objects and advantages which have been sought therefore. It should be understood that many changes, modifications, variations and other uses and applications will become apparent to those skilled in the art after considering this specification and the accompanying drawings. Therefore, any and all such changes, modifications, variations, and other uses and applications which do not depart from the spirit and scope of the invention are deemed to be covered by the invention.

What is claimed is:

1. A rigging cable cleaning device adapted for wrapped disposition about a sailboat rigging cable and movement therealong for purposes of cleaning same during movement of the rigging cable in a sailboat sailing operation, said rigging cable cleaning device comprising:

a) an outer cover formed of a flexible and foldable material capable of being wrapped about a rigging cable;

b) an exterior surface and an interior surface formed on said outer cover;

c) a cleaning pad releasably secured to the interior surface of said cover and also being formed of a flexible and foldable material which is capable of being wrapped about a rigging cable along with said cover, said cleaning pad having a cleaning surface which is cable of cleaning the rigging cable during relative movement between the rigging cable and the cleaning pad; and d) means for releasably locking said cover about a rigging cable in such manner that the cleaning device is allowed to move relative to the rigging cable as the cable is moved upwardly and downwardly relative to a boat deck in a sailboat sailing operation, said cover being of a size sufficient to at least partially wrap around the cable and allow the cleaning pad to be in contact with the cable and thereby allow for a cleaning of the cable during movement of the cleaning device on the cable.

2. The rigging cable cleaning device of claim 1 further characterized in that said cleaning pad is releasably secured to the interior surface of said cover by means of fiber fastening strips and wherein one set of fiber fastening strips is located on the interior surface of said cover and another set of cooperating fiber fastening strips is located on said pad for operative and releasable attachment to one another.

3. The rigging cable cleaning device of claim 1 further characterized in that a plurality of individual differing types of cleaning pads are adapted for releasable attachment to said cover.

4. The rigging cable cleaning device of claim 1 further characterized in that said means for locking comprises fiber fastening strips for releasably securing edges of said cover together.

5. The rigging cable cleaning device of claim 4 further characterized in that said means for locking also comprises openings to receive a shackle for holding the cleaning device about a rigging cable so that the shackle and the cleaning device secured thereto has a relative movement to the cable during movement of the latter.

6. The rigging cable cleaning device of claim 4 further characterized in that only a single cleaning pad is removably secured to the interior surface of said cover.

7. The rigging cable cleaning device of claim 1 further characterized in that a plurality of differing cleaning pads are mounted on the interior surface of said cleaning device and some of which have different abrasive characteristics than others of the cleaning pads.

8. A rigging cable lubricating device adapted for wrapped disposition about a sailboat rigging cable and movement therealong for purposes of cleaning same during movement of the rigging cable in a sailboat sailing operation, said rigging cable lubricating device comprising:

a) an outer cover formed of a flexible and foldable material capable of being wrapped about a rigging cable;

b) an exterior surface and an interior surface formed on said outer cover;

c) a lubricating pad secured to the interior surface of said cover and also being formed of a flexible and foldable material which is absorbent of a lubricating oil, said lubricating pad capable of being wrapped about a rigging cable along with said cover, said lubricating pad also capable of imparting a lubricating fluid to said cable during relative movement between said cable and lubricating pad; and d) means for releasably locking said cover about a rigging cable in such manner that the cleaning device is allowed to move relative to the rigging cable as the cable is moved upwardly and downwardly relative to a boat deck in a sailboat sailing operation, said cover being of a size sufficient to at least partially wrap around the cable and allow the cleaning pad to be in contact with the cable and thereby allow for a cleaning of the cable during movement of the cleaning device on the cable.

9. The rigging cable lubricating device of claim 8 further characterized in that said pad is releasably secured to the interior surface of said cover.

10. The rigging cable lubricating device of claim 9 further characterized in that said lubricating pad is releasably secured to the interior surface of said cover by means of fiber fastening strips and wherein one set of fiber fastening strips is located on the interior surface of said cover and another set of cooperating fiber fastening strips is located on said pad for operative and releasable attachment to one another.

11. The rigging cable lubricating device of claim 8 further characterized in that said means for locking comprises fiber fastening strips for releasably securing edges of said cover together.

12. A method of cleaning a rigging cable of a sailboat with a cleaning device capable of being wrapped about the rigging cable of the sailboat, said method comprising:

a) securing at least one of a plurality of differing types of cleaning pads to the interior surface of a flexible and foldable cover;

b) wrapping said cover and cleaning pad on the interior surface thereof about said rigging cable so that the cleaning pad is in contact with and partially envelopes a section of the rigging cable;

c) releasably locking said cleaning pad about said rigging cable in a position where it is capable of being moved along said rigging cable; and d) enabling movement of said cleaning device along the axis of said rigging cable in such manner that the cleaning device is allowed to move relative to the rigging cable as the cable is moved upwardly and downwardly relative to a boat deck to thereby clean the cable as there is relative movement between the cleaning device and the cable during normal movement of the cable in a sailboat sailing operation.

13. The method of cleaning a rigging cable of claim 12 further characterized in that said method comprises:

a) causing movement of the rigging cable with the cleaning device disposed thereabout to provide a relative movement of the cleaning device and the rigging cable;

b) providing a first fiber fastening strip on said interior surface of said outer cover; and c) providing a second fiber fastening strip on said cleaning pad and releasably attaching said first fiber fastening strip to said second fiber fastening strip to thereby permit releasable attachment of the device about the cable with the pad in cleaning contact with the cable.

14. A rigging cable cleaning device adapted for wrapped disposition about a sailboat rigging cable and movement therealong for purposes of cleaning same, said rigging cable cleaning device comprising:

a) an outer cover formed of a flexible and foldable material capable of being wrapped about a rigging cable;

b) an exterior surface and an interior surface formed on said outer cover;

c) a cleaning pad releasably secured to the interior surface of said cover and also being formed of a flexible and foldable material which is capable of being wrapped about a rigging cable along with said cover, said cleaning pad having a cleaning surface which is cable of cleaning the rigging cable during relative movement between the rigging cable and the cleaning pad; and d) means for releasably locking said cover about a rigging cable and fixedly but nevertheless slidably holding the cleaning device about the cable, said means for releasably locking including a separate hole at each end of said outer cover and being spaced apart from one another by a distance to receive a shackle and thereby allow relative movement between the cleaning device and the rigging cable as the cable is moved upwardly and downwardly in a sailboat sailing operation, said cover being of a size sufficient to at least partially wrap around the cable and allow the cleaning pad to be in contact with the cable and thereby allow for a cleaning of the cable during movement of the cleaning device on the cable.

15. The rigging cable cleaning device of claim 14 further characterized in that said cleaning device is releasably secured about a rigging cable by an additional set of fiber fastening strips forming part of said means for releasably locking and wherein one of the fiber fastening strips of said additional set is located on the inner surface of said cover at an end thereof and another one of cooperating fiber fastening strips of the additional set is also located on the inner surface at an opposite end of the cover for operative attachment to one another.

16. The rigging cable cleaning device of claim 14 further characterized in that a plurality of individual differing types of cleaning pads are adapted for releasable attachment to said cover.

17. The rigging cable cleaning device of claim 14 further characterized in that only a single cleaning pad is removably secured to the inner surface of said cover.

18. The rigging cable cleaning device of claim 1 further characterized in that a plurality of differing cleaning pads are mounted on the interior surface of said cleaning device and some of which have different abrasive characteristics than others of the cleaning pads.

19. A rigging cable cleaning device adapted for wrapped disposition about a sailboat rigging cable and movement therealong for purposes of cleaning same during movement of the rigging cable in a sailboat sailing operation, said rigging cable cleaning device comprising:

a) an outer cover formed of a flexible and foldable material capable of being wrapped about a rigging cable;

b) an exterior surface and an interior surface formed on said outer cover;

c) a plurality of different cleaning pads mounted on the interior surface of said cover and also being formed of a flexible and foldable material which is capable of being wrapped about a rigging cable along with said cover, some of said cleaning pads having different abrasive characteristics than others of said cleaning pads, each of said cleaning pads having a cleaning surface which is cable of cleaning the rigging cable during relative movement between the rigging cable and the cleaning pad; and d) means for releasably locking said cover about a rigging cable in such manner that the cleaning device is allowed to move relative to the rigging cable as the cable is moved upwardly and downwardly relative to a boat deck in a sailboat sailing operation.

* * * * *